United States Patent [19]

Foster et al.

[11] 4,251,295

[45] Feb. 17, 1981

[54] METHOD OF PREPARING AN ORIENTED LOW ALLOY IRON FROM AN INGOT ALLOY HAVING A HIGH INITIAL SULFUR CONTENT

[75] Inventors: Karl Foster; Donald R. Thornburg, both of Forest Hills; Gary C. Rauch, Murrysville, all of Pa.

[73] Assignee: Westinghouse Electric Corp., Pittsburgh, Pa.

[21] Appl. No.: 38,359

[22] Filed: May 11, 1979

[51] Int. Cl.[3] ..... H01F 1/00

[52] U.S. Cl. ..... 148/120; 148/111; 148/31.55; 75/123 L; 75/126 R

[58] Field of Search ..... 148/111, 120, 31.55, 148/110, 112; 75/126 R, 123 L

[56] References Cited

U.S. PATENT DOCUMENTS

| | | | |
|---|---|---|---|
| 1,965,559 | 7/1934 | Goss | 148/111 |
| 3,218,202 | 11/1965 | Ganz | 148/111 |
| 3,849,212 | 11/1974 | Thornburg | 148/31.55 |
| 3,892,605 | 7/1975 | Thornburg | 148/120 |

OTHER PUBLICATIONS

"Development of (110) [001] Texture in Low Alloy Iron by Primary Recrystallization and Normal Grain Growth," vol. 8A, Jan. 1977, Metallurgical Trans.

"Magnetic Properties of (110) [001] Oriented Low Alloy Iron," American Institute of Physics Conference Proceedings–21st Annual Conference–Philadelphia 1975.

*Primary Examiner*—L. Dewayne Rutledge
*Assistant Examiner*—John P. Sheehan
*Attorney, Agent, or Firm*—R. A. Stoltz

[57] ABSTRACT

This is an ingot alloy composition and method suitable for making a low-alloy iron having desirable magnetic characteristics suitable for electrical applications such as transformers cores. The ingot alloy has relatively high (0.012–0.020%) sulfur and thus can be prepared with reduced melting cost (as compared to ingot alloys which are to have low sulfur content). To provide for good sulfur removal during processing, however, the manganese content of the ingot alloy must be kept very low (less than 0.01%, if the final annealing is to be performed at about (800°–1000° C.). The ingot alloy also contains 0.1–2% silicon, 0.1–2% chromium, 0.005–0.030% carbon, less than 0.004% oxygen and the balance essentially iron. The method provides for hot-rolling the above described ingot alloy at 900°–1200° C., annealing for 3–10 hours at 750°–900° C., cold-rolling with a 50–75% reduction, annealing for 3–10 hours at 750°–900° C., and cold-rolling with a 50–75% reduction to final thickness. The final annealing is performed for 24–72 hours at 800° to 1000° C.

5 Claims, No Drawings

METHOD OF PREPARING AN ORIENTED LOW ALLOY IRON FROM AN INGOT ALLOY HAVING A HIGH INITIAL SULFUR CONTENT

CROSS-REFERENCE TO RELATED APPLICATIONS

A processing method and intermediate product alloy for oriented low-alloy iron is described in related Application Ser. No. 038,360 filed concurrently herewith by the same inventors and assigned to the same assignee. This related application has a critical level of sulfur, oxygen, and carbon but can contain relatively broad ranges of silicon and chromium.

An oriented low-alloy iron with certain narrow ranges of silicon and chromium is described in related Application Ser. No. 038,361 filed concurrently herewith by the same inventors and assigned to the same assignee. These related applications may be (but need not necessarily be) practiced together.

BACKGROUND OF THE INVENTION

This invention relates to an iron-based alloy which, when processed in accordance with the method as set forth herein, will produce an oriented grain structure in the finished product which is characterized by a cube-on-edge orientation or as described in Miller indices as (110) [001] grain orientation, and having a primary recrystallized and normal grain growth microstructure. Such magnetic materials are useful, for example, as core materials in power and distribution transformers.

The operating inductions of a large portion of today's transformers are limited by the saturation value of the magnetic sheet material which forms the core. In extensive use today is an iron-based alloy containing nominally 3.25 percent silicon (all composition percentages herein are in weight percent) which is processed in order to obtain cube-on-edge or (110) [001] grain orientation in the final product. A well-known example of this type of steel is called type M-5. These 3.25 percent silicon steels have the final grain orientation developed by means of a secondary recrystallized microstructure. This microstructure is attained during the final box annealing in which preferentially oriented grains grow at the expense of non-preferentially oriented grains with the result that the alloy usually has an extremely large grain structure size in which the diameter usually greatly exceeds the thickness of the sheet material. Obtaining such large grains in a secondarily recrystallized microstructure requires a long time, high temperature anneal for the development of the orientation. The extensive anneal is generally also required for the reduction of residual sulfur content. Sulfur contents in excess of about 100 ppm in the finished product adversely affect the magnetic characteristics exhibited by the silicon-iron alloy.

In addition to the costly long time, high temperature anneal, the addition of 3.25 percent silicon to pure iron, while effective and generally desirable for improving the volume resistivity, nevertheless lowers the saturation value in most commercially produced 3.25% silicon containing iron alloys to generally about 20,300 gauss. Thus, there is the obvious trade-off as the improved resistivity (which lowers core losses of the material) is obtained at the expense of saturation value (significantly lower than the saturation value of about 21,500 gauss of commercially pure iron). Moreover, since commercial iron has substantially higher core losses and substantially higher coercive force values than silicon steel, it was prudent to balance the overall magnetic characteristics and the best balance heretofore obtained was that of the 3.25-percent-silicon iron alloy which exhibited the cube-on-edge orientation.

An alternative to the generally used commercial alloy is described in U.S. Pat. No. 3,849,212, issued Nov. 19, 1974, and the associated primary recrystallization method of U.S. Pat. 3,892,605, issued July 1, 1975 (both to Thornburg) which relate to an iron base alloy made from an ingot containing up to about 0.03 percent carbon, up to 1 percent manganese, from about 0.3 to about 4 percent of at least one of the volume resistivity improving elements selected from the group consisting of up to about 2 percent silicon, up to 2 percent chromium, and up to about 3 percent cobalt. The balance of the alloy is essentially iron with incidental impurities. Thornburg's method utilizes processing by hot working and either a two- or three-stage cold rolling operation, with the final cold rolling stage working effecting only a moderate (50–75 percent) reduction in the cross sectional area of the material being processed. These prior patents deal in relatively broad ranges of composition and do not recognize the criticality between constituents.

SUMMARY OF THE INVENTION

The present invention relates to an iron-based alloy for use in the manufacture of high permeability, primarily recrystallized, low-alloy iron and a method for making such low-alloy iron. The ingot alloy consists essentially of .012–.020% sulfur, 0.1–2.0% silicon, 0.1–2.0% chromium, less than 0.01% manganese, 0.005–0.030% carbon, 0–0.004% oxygen and the balance iron. The method comprises preparing an ingot alloy as described above, hot-rolling the ingot alloy at 900°–1200° C. (preferably at 1000°–1100° C.), annealing for 3–10 hours at 750°–950° C., cold-rolling with a 50–75% reduction, annealing for 3–10 hours at 750°–950° C., cold-rolling to final thickness with a 50–75% reduction, and final annealing for 24–72 hours at 800°–1000° C. in an atmosphere principally comprising dry hydrogen. The use of such a relatively high sulfur and low manganese ingot alloy allows the formation of a high-permeability material with reduced melting cost.

DESCRIPTION OF THE PREFERRED EMBODIMENT

The aforementioned U.S. Pat. No. 3,849,212 describes strong (110) [001] textures in iron-based alloys with a variety of silicon and chromium levels, and a broad range of manganese content and with sulfur held as low as practicable (hot-band measurements indicated 0.0032 and 0.0024 percents of sulfur.) It has subsequently been discovered that high-permeability iron can be produced with much higher sulfur contents (thus greatly reducing melting cost) when a certain narrow range of alloy ingot composition is used, and in particular where the manganese content is held at or below 0.01%.

Thus in the past, recommended sulfur levels for primary recrystallized alloys generally were 50 ppm or less, since sulfur contents above 100 ppm tended to degrade texture formation during processing and residual sulfur, which was not removed by annealing at 900° C. or below, resulted in high coercive force and core loss values. Maintaining low level sulfur presents a problem, however, since melting to 50 ppm or less sulfur raises melting cost.

A series of tests was performed to investigate whether changes in composition of the ingot alloy might allow the sulfur content to be increased in the melt composition and still allow sulfur removal by annealing at about 900° C., thereby allowing texture development and good magnetic properties.

Among the compositions investigated were the alloys shown below in Table 1.

TABLE 1

| Alloy | % Si | % Cr | % Mn | % S |
|---|---|---|---|---|
| SB77 | 0.28 | 0.28 | 0.15 | 0.002 |
| SB76 | 0.28 | 0.29 | 0.11 | 0.012 |
| SB92 | 0.28 | 0.28 | 0.11 | 0.014 |
| SB80 | 0.28 | 0.28 | <0.01 | 0.013 |
| SB209 | 0.80 | 0.60 | <0.002 | 0.012 |
| SB212 | 0.80 | 0.60 | 0.02 | 0.012 |

The alloys of Table 1 were induction melted under inert atmosphere using purified electrolytic iron and high purity alloy additions. These ingot alloys were hot-rolled at 1050° C. to 0.180 inches, pickled, annealed for 5 hours at 850° C., warm-rolled to 0.080 inches, annealed for 5 hours at 850° C., warm-rolled to 0.040 inches, cold-rolled to 0.020 inches, annealed for 1 hour at 850° C., and cold-rolled to 0.006 inches. Epstein samples of the final gauge material were annealed for 48 hours at 900° C. in dry hydrogen.

The magnetic properties and resistivities obtained are shown below in Table 2. The measurements include the $H_c$ in Oe (coercive force in Oersteds), $B_{10}$ values in kG (induction in a 10 Oersted field) and $P_c$ values in W/lb. (core loss at 60 Hz in watts per pound) at both 15 and 17 kilogauss.

TABLE 2

| | DC | | | 60 Hz | |
|---|---|---|---|---|---|
| Alloy | $H_c$ (Oe) | $B_{10}$ (kG) | $P_{c15}$ (W/lb) | $P_{c17}$ (W/lb) | Resistivity microhm-cm |
| SB77 | 0.187 | 18.7 | 0.655 | 0.883 | 17.0 |
| SB76 | 0.440 | 17.2 | 1.05 | 1.49 | 16.9 |
| SB92 | 0.412 | 17.4 | 0.982 | 1.43 | 15.3 |
| SB80 | 0.140 | 19.9 | 0.629 | 0.775 | 16.5 |
| SB209 | 0.145 | 18.4 | 0.56 | 0.78 | 24.9 |
| SB212 | 0.252 | 16.0 | 0.91 | — | 25.1 |

Alloy SB77, which has no sulfur addition, had a fairly low coercive force, high $B_{10}$, and low losses for an alloy with a relatively low (17 microhm-centimeters) resistivity. Alloys SB76 and SB92, which had both manganese and sulfur additions, had much lower $B_{10}$ values, indicating poor texture development, and much higher coercive force values and higher losses. Alloy SB80, which had a sulfur addition but very low manganese, had a very low coercive force value, an extremely high $B_{10}$, and excellent losses for this type of alloy. Alloys SB209 and SB212 illustrate the effects of somewhat higher silicon and chromium contents.

Sulfur contents measured before and after final annealing are shown below in Table 3.

TABLE 3

| | % S | |
|---|---|---|
| Alloy | Cold rolled | Annealed 900° C. |
| SB76 | 0.013 | 0.011 |
| SB92 | 0.016 | 0.008 |
| SB80 | 0.014 | <.0005 |

The data of Table 3 shows that for alloys SB76 and SB92, which contained the significantly more manganese normally used, annealing at 900° C. resulted in little sulfur removal. Annealing of alloy SB80, which had very low manganese (no manganese addition), at 900° C. resulted in extremely good sulfur removal, allowing very good texture development and excellent magnetic properties.

The effects of manganese on somewhat lower sulfur contents and a different process were studied in another series of experiments. The ingot compositions used are shown in Table 4 below.

TABLE 4

| Alloy | % Si | % Cr | % Mn | % S |
|---|---|---|---|---|
| SB84 | 1.14 | 0.28 | 0.28 | 0.0047 |
| SB90 | 1.17 | 0.28 | 0.01 | 0.0063 |

The alloys of Table 4 were processed by hot-rolling at 1050° C. to 0.100 inches, pickling, cold-rolling to 0.020 inches, annealing for 1 hour at 850° C., cold-rolling to 0.006 inches, and then annealing Epstein samples for 48 hours at 900° C.

The magnetic properties and resistivities obtained are summarized in Table 5 below.

TABLE 5

| | DC | | | 60 Hz | |
|---|---|---|---|---|---|
| Alloy | $H_c$ (Oe) | $B_{10}$ (kG) | $P_{c15}$ (W/lb) | $P_{c17}$ (W/lb) | Resistivity microhm-cm |
| SB84 | 0.240 | 17.9 | 0.626 | 0.901 | 26.4 |
| SB90 | 0.178 | 17.9 | 0.575 | 0.830 | 24.6 |

Although this process did not produce as good textures as the initially described process, both alloys had the same $B_{10}$ value indicating the same degree of texture, however alloy SB84 had a considerably higher coercive force and much higher losses than alloy SB90. The sulfur analyses shown below in Table 6 were obtained before and after final annealing of these alloys.

TABLE 6

| | % Sulfur | |
|---|---|---|
| Alloy | As rolled | Annealed 900° C. |
| SB84 | 0.0050 | 0.0037 |
| SB90 | 0.0055 | <0.0005 |

It can be seen that alloy SB84, which contained 0.28% manganese, exhibited very little sulfur removal on annealing at 900° C., while alloy SB90, which had no manganese addition, shows essentially complete sulfur removal and substantially improved magnetic properties.

Thus it can be seen that ingot alloys having low (less than 0.01%) manganese allow the use of relatively high (0.012–0.02%) sulfur. These levels can be used with 0.1–2.0 (preferably 0.1–0.5%) silicon, 0.1–2.0 (preferably 0.1–0.5%) chromium, 0.005–0.030% carbon, and up to 0.004% oxygen, (the balance being essentially iron). Such an ingot alloy is hot-rolled at 900°–1200° C. (preferably at 1000°–1100° C.), annealed for 3–10 hours for 750°–900° C., cold-rolled (as used herein the therm cold-rolled also includes warm-rolling at up to 300° C.) with a 50–75% reduction, annealed for 3–10 hours at 750°–900° C., cold-rolled with a 50–75% reduction to final thickness and final anneal for 24–72 hours at about 900 (800–1000)° C. in an atmosphere principally comprising dry hydrogen. Preferably, the final thickness is about 0.005–0.008 inches. An additional cold-rolling step followed by an annealing for 3–10 hours at 750°–950° C. prior to the cold rolling to a final thickness can also be used.

Preferably the ingot alloy contains about 0.28–0.8% silicon, about 0.28–0.6% chromium, less than 0.01% manganese, about 0.013% sulfur, about 0.014% carbon, and has an oxygen content of about 0.0027% or less.

The above-described ingot alloys and processes provide good (110) [001] textures and magnetic properties using fairly high sulfur melt levels when the manganese is very low.

This invention is not to be construed as limited to the particular forms described herein, since these are to be regarded as illustrative rather than restrictive. The invention is intended to cover all compositions and methods which do not depart from the spirit and scope of the invention.

We claim:

1. A method for producing high-permeability, primarily recrystallized, low-alloy iron, said method comprising;

(a) preparing an ingot alloy consisting essentially of 0.012–0.02% sulfur, 0.1–2.0% silicon, 0.1–2.0% chromium, less than 0.01% manganese, 0.005–0.030% carbon, 0–0.004% oxygen and the balance iron;

(b) hot-rolling at 900°–1200° C.;

(c) annealing for 3–10 hours at 750°–950° C.;

(d) cold rolling with a 50–75% reduction;

(e) annealing for 3–10 hours at 750°–950° C.;

(f) cold-rolling with a 50–75% reduction to final thickness; and (g) final annealing for 24–72 hours at 800°–1000° C. in an atmosphere principally comprising dry hydrogen.

2. The method of claim 1, wherein said final thickness is about 0.005–0.008 inches.

3. The method of claim 2, wherein an additional cold-rolling and annealing for 3–10 hours at 750°–950° C. is performed prior to said cold-rolling to final thickness.

4. The method of claim 1, wherein said silicon content is between 0.1 and 0.5% and said chromium content is between 0.1 and 0.5%.

5. The method of claim 1, wherein said ingot alloy contains about 0.28% to 0.8% silicon, about 0.28% to 0.6% chromium, less than 0.01% manganese, about 0.013% sulfur, about 0.014% carbon and about 0.0027% oxygen.

* * * * *